US006712212B2

(12) United States Patent
Auclair

(10) Patent No.: US 6,712,212 B2
(45) Date of Patent: Mar. 30, 2004

(54) CARTON AND A CUSHION MEMBER FOR PLACEMENT INTO A CARTON

(75) Inventor: Jean-Michel Auclair, Chateauroux (FR)

(73) Assignee: Meadwestvaco Packaging Systems, LLC, Stamford, CT (US)

( * ) Notice: Subject to any disclaimer, the term of this patent is extended or adjusted under 35 U.S.C. 154(b) by 0 days.

(21) Appl. No.: 10/223,173

(22) Filed: Aug. 19, 2002

(65) Prior Publication Data

US 2003/0034273 A1 Feb. 20, 2003

Related U.S. Application Data

(63) Continuation of application No. PCT/US01/05166, filed on Feb. 16, 2001.

(51) Int. Cl.[7] ..... B65D 81/02

(52) U.S. Cl. ..... 206/586; 206/453; 206/587; 206/591; 206/594; 206/756; 206/763

(58) Field of Search ..... 206/587–594, 206/583, 585, 586, 521, 756, 763, 418, 453; 220/528, 23.83, 23.86; 229/120.37, 164.2, 104, 161

(56) References Cited

U.S. PATENT DOCUMENTS

| | | | | |
|---|---|---|---|---|
| 1,604,301 A | * | 10/1926 | Osborn et al. | 206/418 |
| 1,812,311 A | | 6/1931 | Wolf | |
| 1,853,746 A | | 4/1932 | Robin | |
| 2,422,152 A | * | 6/1947 | Vatter | 206/418 |
| 2,617,577 A | | 11/1952 | Tardiff | |
| 2,768,737 A | * | 10/1956 | Callahan | 206/418 |
| 2,835,428 A | | 5/1958 | Herzog | |
| 3,050,228 A | | 8/1962 | Lane | |
| 3,389,848 A | | 6/1968 | McKee | |
| 3,515,864 A | * | 6/1970 | Levy et al. | 362/427 |
| 4,134,497 A | | 1/1979 | Dlugopolski | |
| 4,946,037 A | * | 8/1990 | Keith | 206/431 |
| 5,325,967 A | * | 7/1994 | Gonzales | 206/462 |
| 5,494,152 A | * | 2/1996 | Sobczak et al. | 206/3 |
| 5,720,390 A | | 2/1998 | Bostelman | |
| 5,813,523 A | * | 9/1998 | Gnadt et al. | 206/77.1 |
| 5,988,389 A | * | 11/1999 | Buscema | 206/594 |
| 6,149,009 A | * | 11/2000 | DeNola | 206/586 |

FOREIGN PATENT DOCUMENTS

| | | |
|---|---|---|
| DE | 93 00 652 U1 | 5/1993 |
| FR | 2082340 | 12/1971 |
| GB | 338271 | 11/1930 |
| GB | 562770 | 7/1944 |

* cited by examiner

*Primary Examiner*—Jila M. Mohandesi
(74) *Attorney, Agent, or Firm*—Tsugihiko Suzuki

(57) ABSTRACT

A carton, a receptacle and a blank for packaging fragile articles, each comprising an article supporting platform, and upper and lower spacer structures provided to space the platform from the base, top and sides of an outer carton in which the receptacle is disposed, wherein one or more of the upper and lower spacer structures comprises a pair of members extending mutually divergently from the platform such that each of the members terminate at an intersection of a pair of walls of the outer carton.

19 Claims, 5 Drawing Sheets

CARTON AND A CUSHION MEMBER FOR PLACEMENT INTO A CARTON

This is a continuation of international application No. PCT/US01/05166, filed Feb. 16, 2001, which is hereby incorporated by reference.

BACKGROUND OF THE INVENTION

The present invention relates to a carton and a cushion member/receptacle to be placed in the carton to protect the contents of the carton. More particularly, the invention relates to a carton and a cushion member used to package fragile articles such as bottles of perfume or anti-aging cream, for example.

Such fragile articles/products are generally of high value and therefore, breakages during transit or sale are costly and hence undesirable to the manufacturer and seller. One way of combating breakages is to provide a space around the article within the carton which may crumple upon impact, thereby dissipating energy such that the article contained within remains intact. Furthermore, purchasers of such products generally expect that the packaging should be commensurate with the quality and value of the article, and that the article be attractively presented within the packaging.

One example is shown in U.S. Pat. No. 2,835,428 to Herzog discloses an inner and outer carton arrangement, the inner carton being arranged to be spaced from the walls of the outer carton and having a separate lid section that engages within slots provided in the upper edges of the inner carton.

Herzog however fails to provide means for retaining articles within the inner carton and the risk of the articles breaking upon impact with a wall of the inner carton exists. In addition, a complex arrangement of spacers is required to maintain the inner carton in a central position in relation to the outer carton, which inevitably adds to the cost and complexity of manufacturing the carton.

SUMMARY OF THE INVENTION

The present invention and its preferred embodiments seek to overcome or at least mitigate the problems of the prior art.

One aspect of the invention provides a package for packaging fragile articles. The package comprises an outer carton and a receptacle for placement into the outer carton. The receptacle comprises an article supporting platform and upper and lower spacer structures provided to space the platform from the base, top, side and end walls of the outer carton. One or each of the upper and lower spacer structures comprises a pair of spacer members extending mutually divergently from the platform such that each of the spacer members terminate at an intersection of an adjacent pair of the walls of the outer carton.

According to an optional feature of this aspect of the invention, each of the upper and lower spacer structures may comprise a pair of mutually divergently extending spacer members. The each upper spacer member and an adjacent lower spacer member are hingedly connected to the platform along laterally juxtaposed fold lines respectively.

Preferably, the platform is a composite comprising upper and lower platform panels placed in face contacting relationship.

In one class of embodiments, a top protection panel is hingedly connected to the upper spacer structure so as to protect the article to be placed in the receptacle. Optionally, the upper spacer structure comprises a spacer member hingedly connected to the platform, the top protection panel being hingedly connected to the upper spacer member along the upper edge of the upper spacer member.

One or each spacer structure may be provided with an aperture to receive a portion of the article to retain the article in position on the platform.

According to another optional feature of this aspect of the invention, spacer members are arranged in adjacent positions and are hingedly connected to the platform along substantially perpendicularly arranged fold lines.

The side edges of the adjacent spacer members may be interconnected by a gusset structure. Optionally, the gusset structure is arranged to project outwardly of the receptacle. Preferably, the gusset structure engages a corner of the outer carton defined by the intersection of an adjacent pair of the side and end walls of the outer carton.

According to a further optional feature of this aspect of the invention, at least one of the upper and lower spacer structures comprises a pair of trapezoidal flaps each adapted to be engaged with at least two adjacent side walls of the outer carton.

A second aspect of the invention provides a cushion member for placement into an outer carton comprising an article supporting platform having upper and lower spacer members extending upwardly and downwardly from the platform to be engaged respectively with the top and bottom walls of the outer carton, wherein the upper and lower spacer members are hinged to the platform along two juxtaposed fold lines respectively.

According to an optional feature of the second aspect of the invention, the platform may be a composite structure comprising upper and lower platform panels placed in face contacting relationship, and the upper and lower spacer members may be hinged to the upper and lower platform panels respectively.

According to another optional feature of the second aspect of the invention, a top protection panel may be hingedly connected to the upper spacer member so as to protect an article to be placed on the platform.

According to a further optional feature of the second aspect, the upper spacer member may be provided with an aperture for receiving a portion of an article to retain the article in position on the platform.

According to a further optional feature of the second aspect, a second upper spacer member may be provided to extend upwardly from the platform. The upper spacer members may be disposed in adjacent positions and may be hingedly connected to the platform along substantially perpendicularly arranged fold lines. Preferably, the side edges of the upper spacer members are interconnected by a gusset structure which may be arranged to project outwardly of the cushion member.

BRIEF DESCRIPTION OF THE DRAWINGS

Exemplary embodiments of the present invention will now be described, by way of example only, with reference to the accompanying drawings in which.

DETAILED DESCRIPTION OF THE PREFERRED EMBODIMENT

Figure 1:
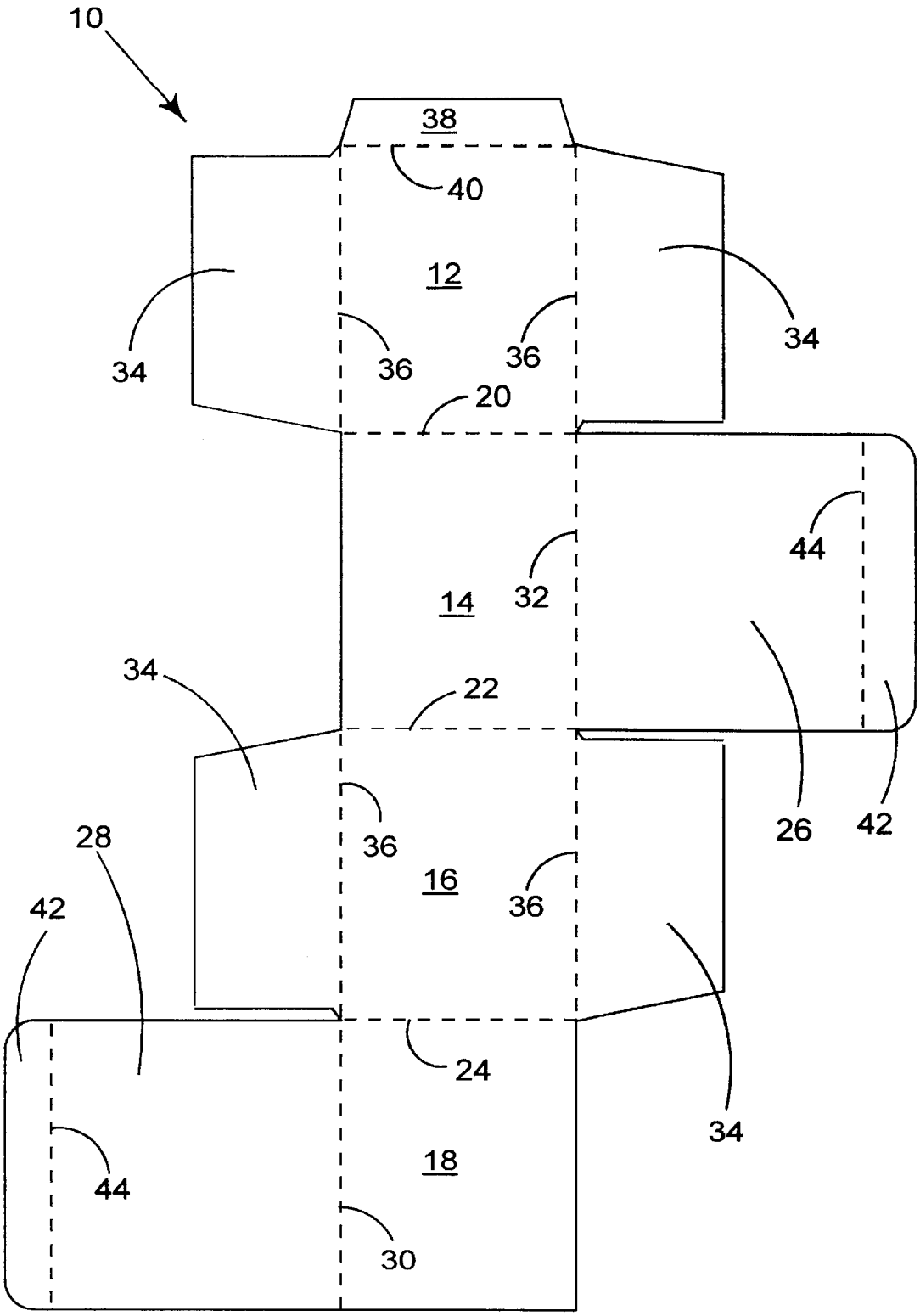
FIG. 1 is a plan view of a blank for forming an outer carton according to an embodiment of the invention.

Referring to the drawings and in particular FIG. 1 there is shown a blank 10 for forming an outer carton made from paperboard or other like foldable sheet material. The outer carton is formed from side and end panels 12, 14, 16 and 18 all hingedly connected together in series along fold lines 20, 22 and 24. There further comprises top panel 26 and base panel 28 hingedly connected to opposing end panels 14 and 18 respectively along fold lines 32 and 30. Preferably, there also comprises end support flaps 34 hingedly connected to side panels 16 and 12 along fold lines 36 used to provide additional support for the outer carton. A glue flap 38 is hingedly connected to side panel 12 along fold line 40 and top and base panels 26 and 28 may further comprise a tuck-in flap 42 hingedly connected along fold line 44.

Figure 2:
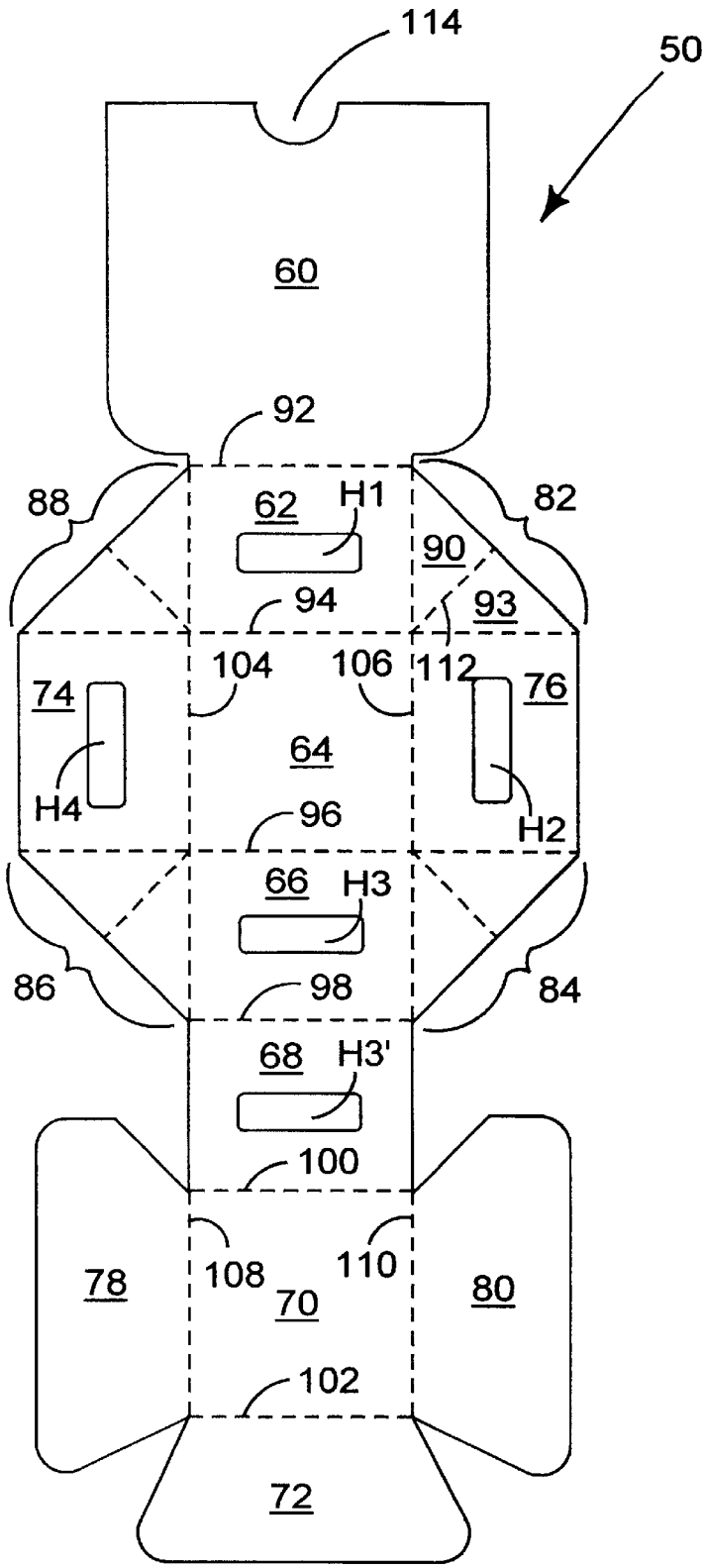
FIG. 2 is a plan view of a blank for forming an article receptacle according to an embodiment of the invention.

Turning to the cushion member or receptacle shown in FIG. 2, there further comprises a blank 50 also made from paperboard or other like foldable sheet material. The receptacle is adapted to be placed in an outer carton, one example of which is illustrated in FIG. 1. The blank 50 comprises an article supporting platform 64, 70, upper and lower spacer structures being provided to space the platform from the base panel 28, top panel 26 and side and end panels 12, 14, 16, 18 of an outer carton in which the receptacle is disposed, wherein one or more of the upper and lower spacer structures comprises a pair of members 78, 80 extending mutually divergently from the platform such that each of the members terminate at an intersection of a pair of walls of the outer carton.

One example of a receptacle is formed from the blank 50 comprising in series a top protection panel 60, first upper spacer member 62, upper platform panel 64, second upper spacer member 66, connecting panel 68, lower platform panel 70 and first lower spacer member 72 hingedly interconnected along fold lines 92, 94, 96, 98, 100 and 102 respectively. The upper spacer structure comprises, in this embodiment, the upper spacer members 62, 66. The upper spacer structure preferably further comprises third and fourth upper spacer members 74 and 76 hingedly interconnected to opposed edges of upper platform panel 64 along fold lines 104 and 106 respectively. In this embodiment, lower spacer structure comprises the lower spacer member 72.

Gusset structures 82, 84, 86 and 88 advantageously interconnect the side edges of adjacent upper spacer members 62, 66, 74, 76. Each gusset structure is substantially identical and therefore, only structure 82 will be described in further detail. The structure 82 preferably comprises a pair of triangular gusset panels 90 and 93. Panel 90 is hingedly interconnected to spacer member 62 along an extension of fold line 106 and panel 93 is hingedly interconnected to spacer member 76 along an extension of fold line 94. Gusset panels 90 and 93 are mutually interconnected along a fold line 112 that preferably intersects with fold lines 94 and 106 at the corner of platform panel 64.

The gusset structures 82, 84, 86, 88 are preferably arranged such that once the receptacle is erected and placed in the outer carton, fold line 112 terminates proximate one of fold lines 20, 22, 24 or 40 of the outer carton thereby imparting additional rigidity to the carton.

In addition, the free edges of the gusset panels 90, 93 may advantageously be arranged to be substantially in contact with the respective side/end panels of the outer carton, thereby effectively closing the lower portion of the outer carton from view from above as described in more detail below. This may also impart additional rigidity to the carton, once erected, and furthermore enhances the presentation of the article within the carton. In alternative classes of embodiment, however, gusset panels may not be provided. In these embodiments, the upper spacer members may be trapezoidal in shape, which may again impart additional rigidity to the carton, as well as closing the lower portion of the carton from view.

The lower spacer structure preferably further comprises second and third lower spacer members 78 and 80 hingedly interconnected to lower platform panel 70 along fold lines 108 and 110 respectively. Lower spacer panels 72, 78 and 80 are preferably substantially trapezoidal in shape such that when the receptacle is erected, the side edges thereof are placed in mutual contact as is perhaps best illustrated in FIGS. 6 and 9. This shape permits the spacer members to intersect with fold lines 20, 22, 24, 40 at the corners of the outer carton 10.

In order to positively retain the article A within the receptacle, upper spacer members 62, 66, 74 and 76 may be optionally provided with apertures H1, H3, H4 and H2 respectively. In this embodiment, these apertures are shown to be elongate in order to retain a protruding portion such as a lip or lid or a flange provided on the article. It should be understood however, that in other classes of embodiment, the shape of the apertures may be altered according to the shape of the article to be packaged. In addition, an aperture H3' is provided in connecting panel 68 such that once, as part of the receptacle erection process, panels 66 and 68 are brought into face contacting relationship, aperture H3' will be placed substantially in register with aperture H3.

Optionally, a cut-away portion 114 of top protection panel 60 is provided to enable the end user to more easily engage and lift the top protection panel 60 in order to gain access to the article once the receptacle is erected and loaded.

Turning to the construction and loading of the receptacle and carton as illustrated in FIGS. 3 to 9, it is envisaged that the carton of the present invention can be formed by a series of sequential folding and gluing operations which can be performed in a straight line machine so that the carton is not required to be rotated or inverted to complete its construction. The folding process is not limited to that described below and can be altered according to particular manufacturing requirements.

Figure 3:
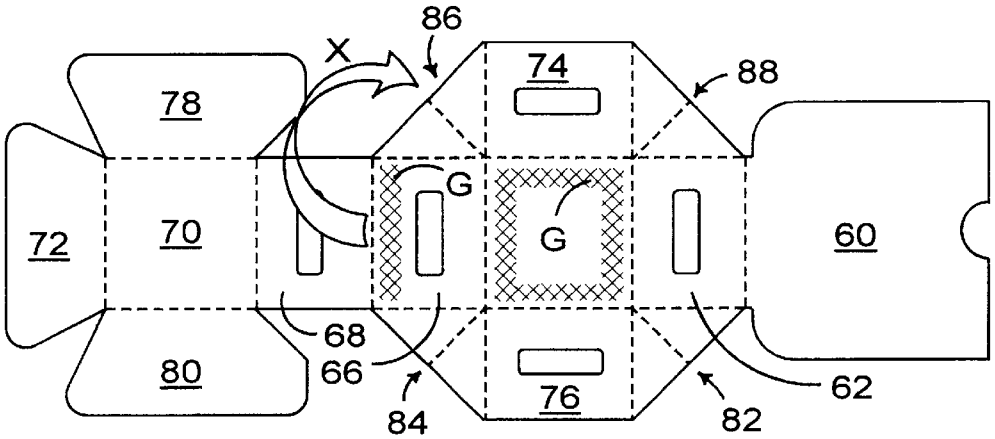
FIG. 3 is a plan view of the receptacle blank shown prior to the first stage of construction.
Figure 4:
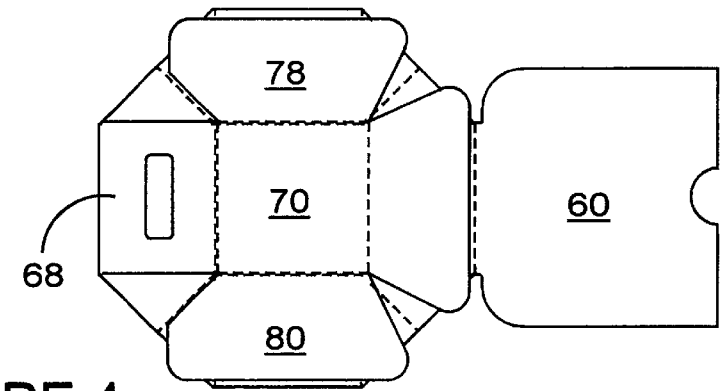
FIG. 4 is a plan view of the blank in a partially folded state.

Referring in particular to FIG. 3, the article platform is first constructed whereby glue G is preferably applied to cross hatched areas of upper platform panel 64 and second upper spacer member 66. Alternatively, glue G may be applied to connecting panel 68 and lower platform panel 70. Connecting panel 68 is then folded about fold line 98 in a direction indicated by arrow X such that lower platform panel 70 overlies upper platform panel 64 and is secured thereto. Likewise, connecting panel 68 is secured to second upper spacer member 66 as illustrated in FIG. 4. It is envisaged that alternative securing means known in the art may be used instead of glue.

Fold lines 94, 96, 104 and 106 are now in substantially juxtaposed parallel alignment with fold lines 102, 100, 108 and 100 respectively, although it is envisaged that in alternative embodiments this may not necessarily be the case. The blank may be supplied to a packaging plant in this flat collapsed form shown in FIG. 4 for subsequent erection as outlined below.

Figure 5:
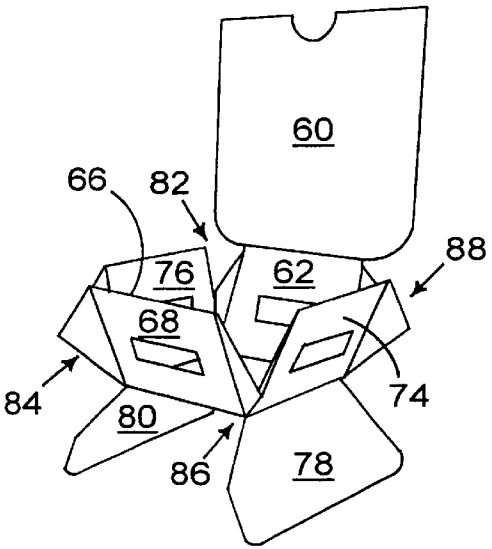
FIG. 5 is a perspective view of the receptacle when ready to receive an article.

To erect the receptacle to a point at which it may receive an article as illustrated in FIG. 5, lower spacer members 72, 78 and 80 are folded downwardly out of alignment with lower platform panel 70 along fold lines 102, 108 and 110 respectively preferably such that the side edges of adjacent members are brought into substantial contact. Upper spacer members 62, 66, 74, 76 are similarly folded upwardly about fold lines 94, 96, 104 and 106 as illustrated in FIG. 5 such that gusset structures 82, 84, 86 and 88 project outwardly thereof.

Figure 6:
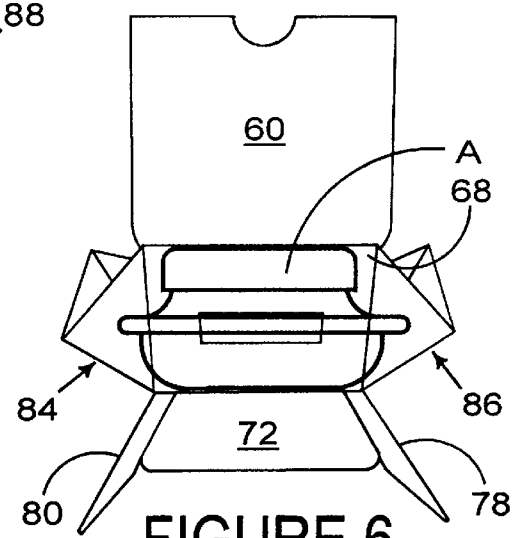
FIG. 6 is an end view of the receptacle with the article in place.
Figure 7:
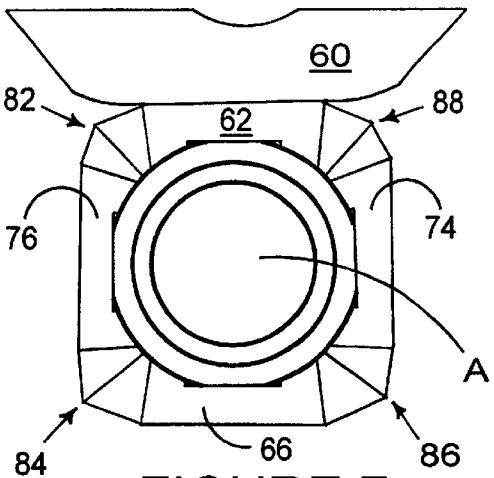
FIG. 7 is a view from above of the receptacle with the article in place.

As shown in FIG. 6, article A can then be introduced into the receptacle, and is preferably supported on composite platform panels 64 and 70. The edge of the article may be located in apertures H1, H2, H3 and H4 as can perhaps be most clearly seen in FIG. 7. The platform and apertures may act together to substantially prevent any vertical or horizontal movement of the article. In other embodiments, one or more apertures may be dispensed with, or alternatively, the apertures may be configured differently such that the article A is lifted above the platform panels 64 and 70.

Figure 8:
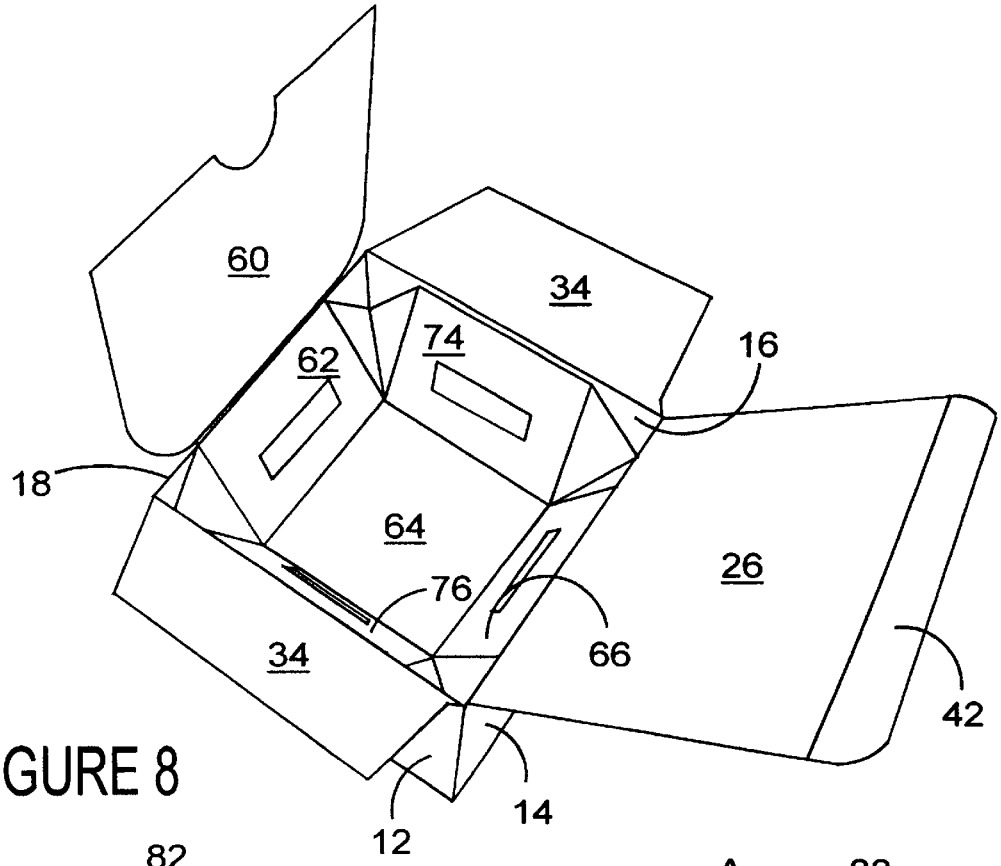
FIG. 8 is a perspective view of the receptacle positioned inside the carton in an erected and set up condition ready to receive an article.

Turning now to FIG. 8, once the receptacle has been folded as shown in FIG. 5, it may be introduced into an outer carton formed from the blank as shown in FIG. 1. To form a carton from the blank illustrated in FIG. 1, side and end panels 12, 14, 16, 18 are folded out of mutual alignment along fold lines 20, 22 and 24 so as to form a tubular structure secured together by gluing, or otherwise securing flap 38 to panel 18. The receptacle may then be loaded into the outer carton either from above or below, and the base structure of the outer carton is completed by inwardly folding lower end support flaps 34 about fold lines 36 and base panel 28 about fold line 30. Tuck-in flap 42 of base panel 28 is folded about fold line 44 so as to be placed in face contacting relationship with end panel 14. The carton is now as shown in FIG. 8, and is ready for the article A to be loaded. In alternative loading/construction methods, the article A may be placed in the receptacle prior to the receptacle being loaded in the outer carton.

Once the article A has been loaded, top protection panel 60 is folded inwardly so as to overlie the top of the article. Top end support flaps 34 are folded inwardly so as to overlie protection panel 60, and finally top panel 26 and tuck-in flap 42 are folded inwardly such that flap 42 is placed in face contacting relationship with end panel 18, and the top panel 26 overlies end support flaps 34.

Figure 9:
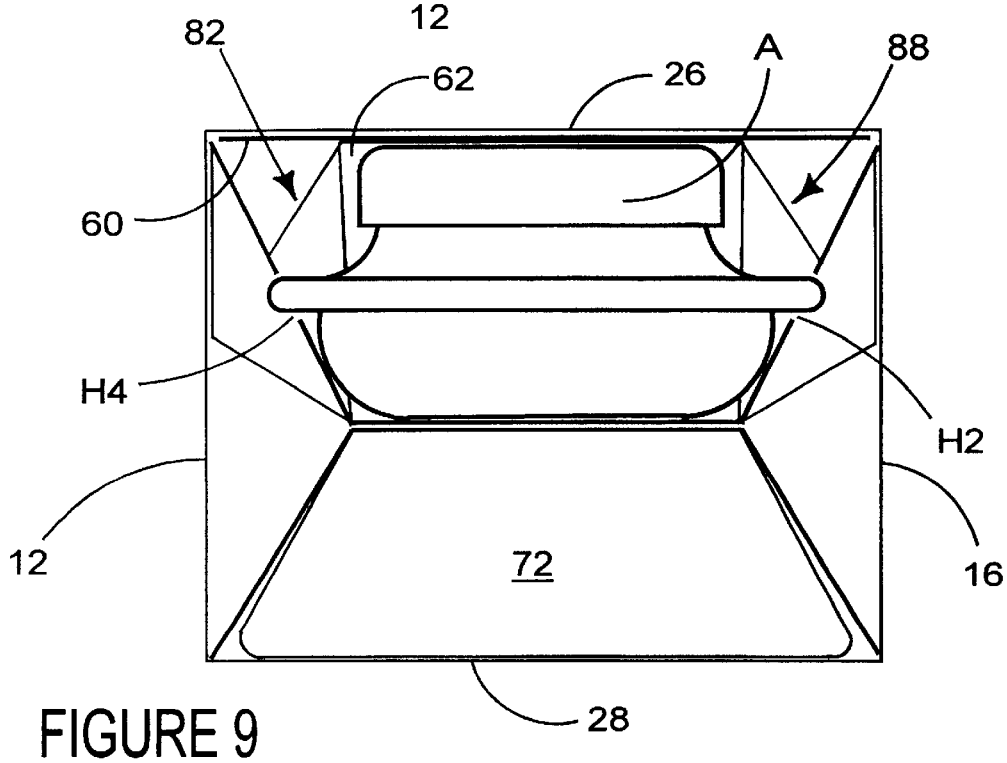
FIG. 9 is a partial cross-sectional view through the receptacle and outer carton shown in FIG. 8 in a set up and loaded condition.

The carton is now in a fully erected and loaded state. A partial cross sectional view through the completed carton is illustrated in FIG. 9. It can be seen that the receptacle spaces the article away from the side, end and base panels of the outer carton as well as preventing unwanted horizontal and vertical movement of an article within the carton. This minimizes the risk of damage being caused to the article A. If necessary, the configuration of the receptacle may be adjusted such that a space is also provided above the article A.

To remove the article from the packaging, the end user opens top panel 26, top end support flaps 34 and top protection panel 60, and lifts the article from the platform 64, 70. Where the article is retained in apertures, it may be necessary to lift the receptacle relative to the outer carton, such that the upper spacer members 62, 66, 74, 76 have space to fold outwardly and release the article. Alternatively, the upper spacer members may be deformed towards the walls of the outer carton to enable release.

It is envisaged that the receptacle of the invention can be automatically erected so as to act as a spacer by employing configurations other than those described above, without departing from the scope of invention. For example, the platform need not be centrally positioned. The overall receptacle configuration strengthens the carton structure and assists in maintaining a tubular structure when for example the carton is stored on a supermarket shelf. The platform provides further support for the article contained within it.

It is envisaged that in alternative embodiments, a two part blank may be used to form the receptacle. In such embodiments, connecting panel 68 is dispensed with and may in some embodiments be replaced by a further lower spacer member. Alternatively, the outer carton and receptacle may be formed from a unitary blank, for example the top panel 26 may also be the cover panel 60.

Furthermore the supporting platform will tend to crumple in the event of excessive or sudden movement of the article within the carton or due to an impact with a foreign body for example during transit, thereby to dissipate the forces, and reduce the risk the article will be damaged.

It will be recognized that as used herein, directional references such as "top", "base", "end", "upper", "lower" and "side" do not limit the respective panels to such orientation, but merely serve to distinguish these panels from one another. Any reference to hinged connection should not be construed as necessarily referring to a single fold line only: indeed it is envisaged that hinged connection can be formed from one or more of one of the following, a score line, a frangible line or a fold line, without departing from the scope of invention.

The present invention and it preferred embodiments relate to a carton and/or receptacle which is shaped to provide satisfactory rigidity to hold fragile items such as bottles securely but with a degree of flexibility. The shape of the blank minimizes the amount of paperboard required for the carton. The carton can be constructed from a flat collapsed condition to a position of use by hand or automatic machinery. The receptacle and carton may be adapted to package more than one article therein. The caliper and grade of paperboard may be adjusted according to the particular strength and deformation characteristics required.

What is claimed is:

1. A package for packaging fragile articles, comprising an outer carton and a receptacle disposed within said outer carton, said outer carton comprising a base wall, a top wall, a pair of side walls and a pair of end walls, said receptacle comprising an article supporting platform disposed at a position spaced from said base, top, side and end walls, and upper and lower spacer structures provided to retain said platform spaced from said base, top, side and end walls, wherein each of said upper and lower spacer structures comprises a pair of spacer members extending mutually divergently from said platform such that each of said spacer members terminate at an intersection of an adjacent pair of said walls of said outer carton.

2. The package according to claim 1 wherein each of said spacer members of said upper spacer structure and an adjacent one of said spacer members of said lower spacer structure are hingedly connected to said platform along laterally juxtaposed fold lines respectively.

3. The package according to claim 1 wherein said platform is a composite structure comprising upper and lower platform panels placed in face contacting relationship.

4. The package according to claim 1 wherein one or each of said spacer structures is provided with an aperture for receiving a portion of an article to retain the article in position on said platform.

5. A package for packaging fragile articles, comprising an outer carton and a receptacle disposed within said outer carton, said outer carton comprising a base wall, a top wall, a pair of side walls and a pair of end walls, said receptacle comprising an article supporting platform and upper and lower spacer structures provided to space said platform from said base, top, side and end walls, wherein one or each of said upper and lower spacer structures comprises a pair of spacer members extending mutually divergently from said platform such that each of said spacer members terminate at an intersection of an adjacent pair of said walls of said outer carton, and wherein said receptacle further comprises a top protection panel hingedly connected to said upper spacer structure so as to protect an article to be placed on said platform.

6. The package according to claim 5 wherein said upper spacer structure comprises said pair of spacer members hingedly connected to said platform, said top protection panel being hingedly connected to one of said spacer members of said upper spacer structure along an upper edge of said one spacer member.

7. A package for packaging fragile articles, comprising an outer carton and a receptacle disposed within said outer carton, said outer carton comprising a base wall, a top wall, a pair of side walls and a pair of end walls, said receptacle comprising an article supporting platform and upper and lower spacer structures provided to space said platform from said base, top, side and end walls, wherein one or each of said upper and lower spacer structures comprises a pair of spacer members extending mutually divergently from said platform such that each of said spacer members terminate at an intersection of an adjacent pair of said walls of said outer carton, and wherein said pair of spacer members of said one or each spacer structure are disposed in adjacent positions and are hingedly connected to said platform along substantially perpendicularly arranged fold lines respectively.

8. The package according to claim 7 wherein side edges of said pair of spacer members of said one or each spacer structure are interconnected by a gusset structure.

9. The package according to claim 8 wherein said gusset structure is arranged to project outwardly of said receptacle.

10. The package according to claim 9 wherein said gusset structure engages a corner of said outer carton defined by an intersection of adjacent ones of said side and end walls of said outer carton.

11. A package for packaging fragile articles, comprising an outer carton and a receptacle disposed within said outer carton, said outer carton comprising a base wall, a top wall, a pair of side walls and a pair of end walls, said receptacle comprising an article supporting platform and upper and lower spacer structures provided to space said platform from said base, top, side and end walls, wherein one or each of said upper and lower spacer structures comprises a pair of spacer members extending mutually divergently from said platform such that each of said spacer members terminate at an intersection of an adjacent pair of said walls of said outer carton, and wherein at least one of said upper and lower spacer structures comprises a pair of generally trapezoidal flaps each adapted to be engaged with at least two adjacent side walls of said outer carton.

12. A cushion member for placement into an outer carton, comprising an article supporting platform and a pair of upper and lower spacer members extending upwardly and downwardly from said platform to be engaged respectively with top and bottom walls of an outer carton, wherein said upper and lower spacer members are hinged to said platform along juxtaposed fold lines respectively, said cushion member further comprising a top protection panel hingedly connected to said upper spacer member so as to protect an article to be placed on said platform.

13. The cushion member according to claim 12 wherein said platform is a composite structure comprising upper and lower platform panels placed in face contacting relationship, and said upper and lower spacer members are hinged to said upper and lower platform panels respectively.

14. The cushion member according to claim 12 wherein said upper spacer member is provided with an aperture for receiving a portion of an article to retain the article in position on said platform.

15. The cushion member according to claim 12 further comprising a second upper spacer member extending upwardly from said platform, wherein said upper spacer members are disposed in adjacent positions and are hingedly connected to said platform along substantially perpendicularly arranged fold lines.

16. The cushion member according to claim 15 wherein side edges of said upper spacer members are interconnected by a gusset structure.

17. A cushion member for placement into an outer carton, comprising an article supporting platform and a pair of upper and lower spacer members extending upwardly and downwardly from said platform to be engaged respectively with top and bottom walls of an outer carton, wherein said upper and lower spacer members are hinged to said platform along juxtaposed fold lines respectively, said cushion member further comprising a second upper spacer member extending upwardly from said platform, wherein said upper spacer members are disposed in adjacent positions and are hingedly connected to said platform along substantially perpendicularly arranged fold lines, wherein side edges of said upper spacer members are interconnected by a gusset structure, and wherein said gusset structure is arranged to project outwardly of said cushion member.

18. A cushion member for placement into an outer carton, comprising an article supporting platform and a pair of upper and lower spacer structures extending upwardly and downwardly from said platform to be engaged respectively with top and bottom walls of an outer carton, wherein at least one of said upper and lower spacer structures comprises a pair of generally trapezoidal flaps disposed in adjacent positions, each of said pair of trapezoidal flaps being connected at one end thereof to said platform, adjacent side edges of said pair of trapezoidal flaps being disposed in mutual contact.

19. The cushion member according to claim 18 wherein said pair of trapezoidal flaps are hinged to said platform along substantially perpendicularly arranged fold lines respectively.

* * * * *